US005168119A

United States Patent [19]

Sands

[11] Patent Number: 5,168,119

[45] Date of Patent: Dec. 1, 1992

[54] EJECTION SYSTEM FOR PAYLOAD DEPLOYMENT IN A LOW GRAVITY, EXOATMOSPHERIC ENVIRONMENT

[75] Inventor: Michael A. Sands, Dana Point, Calif.

[73] Assignee: Rockwell International Corporation, Seal Beach, Calif.

[21] Appl. No.: 812,489

[22] Filed: Dec. 23, 1991

[51] Int. Cl.[5] ..... F41F 3/052

[52] U.S. Cl. ..... 89/1.816; 89/1.51; 89/1/819

[58] Field of Search ..... 102/521, 522, 523; 89/1.51, 1.52, 1.7, 1.809, 1.810, 1.812, 1.816, 1.817, 1.818, 1.819

[56] References Cited

U.S. PATENT DOCUMENTS

| | | | |
|---|---|---|---|
| 3,038,382 | 6/1962 | Noyes et al. | 89/1.816 |
| 3,135,162 | 6/1964 | Kamalian | 89/1.81 |
| 3,499,364 | 3/1970 | D'Ooge | 89/1.81 |
| 4,304,170 | 12/1981 | King | 89/1.816 |
| 4,627,327 | 12/1986 | Huber | 89/1.816 |

*Primary Examiner*—David H. Brown
*Attorney, Agent, or Firm*—Lawrence N. Ginsberg; Charles T. Silberberg

[57] ABSTRACT

An ejection system for payload deployment in a low gravitation exoatmospheric environment. In its broadest aspects, the ejection system includes an elongated launch tube; a payload mountable within the launch tube; and, a plurality of equiangularly spaced, axially aligned spring members secured to an outer surface of the payload. The launch tube includes pre-deployment payload securing means for securely maintaining a payload within the launch tube prior to depolyment. Each spring member provides a forward and an aft dynamic interface between the payload and the launch tube. The utilization of a plurality of spring members provides payload alignment relative to the launch tube prior to and throughout payload ejection.

6 Claims, 2 Drawing Sheets

EJECTION SYSTEM FOR PAYLOAD DEPLOYMENT IN A LOW GRAVITY, EXOATMOSPHERIC ENVIRONMENT

STATEMENT OF GOVERNMENT INTEREST

The Government has rights in this invention pursuant to Contract No. F04701-87-C-0065 awarded by the U.S. Department of the Air Force.

BACKGROUND OF THE INVENTION

1. Field of Invention

The present invention relates to light weight deployment systems for exoatmospheric payloads and more particularly to a debris-less deployment system which utilizes flexible spring members for providing payload alignment relative to a launch tube.

2. Description of the Related Art

There are a multitude of ejection systems described in the prior art which are applicable for ground based deployment of missiles, rockets and other payloads. For example, U.S. Pat. No. 4,393,745, issued to H. C. Mayo et al., entitled "Releasable Retainer for Ejection Tube", discloses a spring assisted, mechanical detent which permits one-way rocket/launch tube assembly and, subsequently, resists axial motion of a rocket. However, no provision is made to resist rocket rotation while in the launch tube and no provisions are indicated with regard to pre-launch rocket alignment in terms of centering and parallelism to the launch tube. Furthermore, no provisions are made to control rocket tip-off (tumbling) as a result of the ejection/launch.

U.S. Pat. No. 4,191,087, issued to B. H. Campbell et al., entitled "Rocket Detent and Release Mechanism", discloses 3-point retention of a rocket to a launch tube by means of spring clip detents and fracturable features for rocket ejection/launch. However, as in the Mayo et al. patent, no provisions are defined for controlling rocket tip-off.

U.S. Pat. No. 4,304,170, issued to D. W. King, entitled "Locking Assembly for a Rocket and Launch Tube", discloses a 2-point retention system for a rocket using leaf spring loaded mechanical detent for axial constraint of a rocket, which subsequently releases due to rocket firing. Again, the rocket tip-off is not controlled during ejection/launch.

U.S. Statutory Invention Registration No. H405 to J. H. Covey, entitled "Rocket/Launcher Interface" discloses the use of tapered pair, circumferential, gap compensating, adapter sabots between a rocket and its launch tube. The sabots compensate for launch tube irregularities during launch and provide tip-off control. There are no provisions for pre-launch structural constraint of the rocket, axially or rotationally, by the sabots. Furthermore, the sabot concept described in this registration requires a cylindrical exterior for the rocket and a cylindrical interior for the launch tube. Lastly, the sabots become debris after the rocket launch event.

U.S. Pat. No. 3,412,640, issued to J. J. Nash, entitled "Rocket Launcher", discloses a launcher for rockets with folding rear fins. It describes a 2-point detent method. No provisions for rocket tip-off control are provided.

U.S. Pat. No. 4,464,972, issued to W. E. Simon, entitled "Lateral Support System for Canister-Launched Missile", discloses a fully circumferential, elastomeric, missile/launch tube gap filler for tip-off control. However, there are no missile pre-launch structural provisions for constraining the missile, axially or rotationally.

U.S. Pat. No. 4,627,327, issued to M. S. Huber, entitled "Hybrid Unitized Shock and Vibration Mitigation System", discloses a fully circumferential, elastomeric, rocket-launch tube gap filler for tip-off control and vibration/shock insulation for a rocket. There are no rocket pre-launch structural mounting provisions indicated for rocket axial and rotational constraint. Additionally, the system disclosed creates debris after rocket ejection/launch.

Generally, the aforementioned ejection systems are not amenable for space applications where generation of debris is to be avoided, non-cylindrical payloads are commonplace, and environmental conditions are severe. Current exoatmospheric applications, such as space shuttle payload deployment systems, overcome many of the previously mentioned deficiencies. These systems are qualified for limited exposure to a space environment and generally include payload spin-up table mechanism and spring actuated ejection devices. Payload spin-up creates an axis which establishes the payload trajectory relative to the thrust centroid of a rocket motor attached to the payload. However, these payload spin-up and spring actuated ejection devices are complex, heavy, bulky, and are designed for large payloads which could not be contained in a launch tube as might be required for payloads subject to long term storage in a spacecraft in space prior to payload deployment.

OBJECTS AND SUMMARY OF THE INVENTION

It is therefore a principal object of the present invention to provide efficient payload deployment in a low gravity, exoatmospheric environment.

It is another object of the present invention to provide for passive payload trajectory control, as might be adversely influenced by launch tube physical discontinuities or ejection force induced overturning moments, without the requirement for payload spin stabilization, before and during the ejection process.

Another object is to provide a debris-less ejection system.

Yet another object is to provide a lightweight ejection system with minimal overall system mass.

Yet another object is to provide an ejection system which is accommodating to recoil-less or reaction-type ejection methods.

Still another object is to provide structural rigidity of the payload relative to the launching mechanism and host spacecraft prior to payload ejection.

Still another object of the present invention is to provide a producibility enhanced design with commonality of parts.

Still another object of the present invention is to provide a simple, readily serviceable, inexpensive, highly reliable ejection system.

The present invention is an ejection system for payload deployment in a low gravitation, exoatmospheric environment. In its broadest aspects, the invention includes an elongated launch tube; a payload mountable within the launch tube; and, a plurality of equiangularly spaced, axially aligned flexible spring members secured to an outer surface of the payload. The launch tube includes pre-deployment payload securing means for securely maintaining a payload/spring member assembly axially, radially, and rotationally within the launch tube prior to deployment. Each spring member provides a forward and an aft dynamic interface between the payload and the launch tube. The utilization of a plurality of spring members provides axial, radial, and, if desired, rotational alignment of the payload relative to the launch tube throughout payload ejection process.

Drag forces produced by the spring members' sliding on the inner surface of the launch tube can be tailored through spring member preload force, spring member physical geometry and material selection. The spring members remain captive to the payload after ejection, thereby eliminating debris.

The present invention allows pre-ejection/launch controlled positioning of external umbilicals (e.g. electrical, mechanical, cryogenic, etc.) between the payload and the host space craft.

Other objects, advantages and novel features of the present invention will become apparent from the following detailed description of the invention when considered in conjunction with the accompanying drawings.

BRIEF DESCRIPTION OF THE DRAWINGS

The same elements or parts throughout the figures are designated by the same reference characters.

DETAILED DESCRIPTION OF THE PREFERRED EMBODIMENTS

Figure 1:
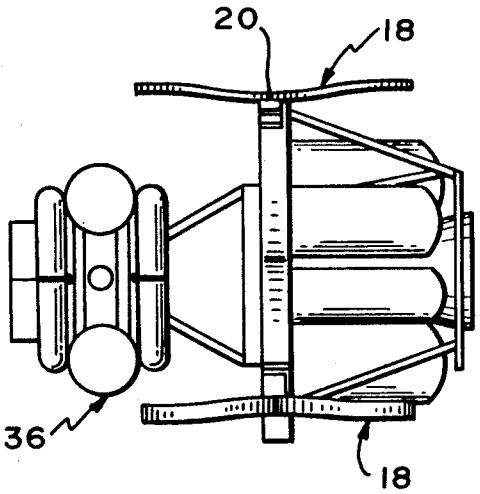
FIG. 1 is a profile view of a representative payload equipped with the flexible spring members of the present invention, as it would appear prior to installation in the launch tube or after ejection from the launch tube.

Referring to the drawings and the characters of reference marked thereon, FIG. 1 illustrates a representative payload spacecraft 36 with spring members 18 attached thereto. As will be described below, these spring members 18 comprise a salient portion of the ejection system of the present invention.

Figure 2:
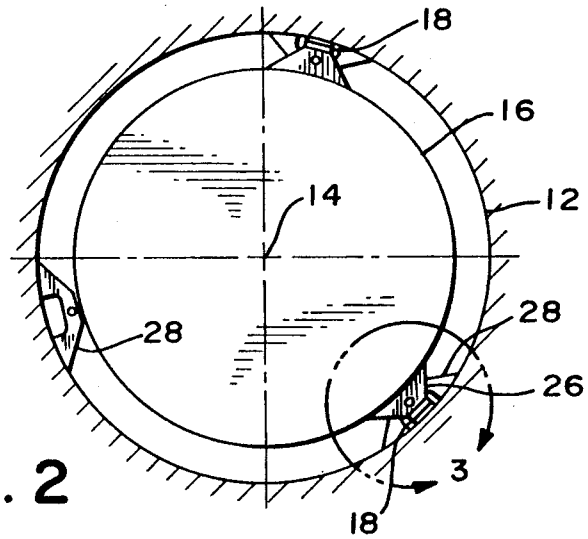
FIG. 2 is an end view, looking aft, of the ejection system of the present invention showing the payload supported within the launch tube. (One of the spring members and spring member support brackets have been omitted for purposes of clarity.)

FIG. 2 shows a payload 16 secured within a launch tube 12. Three equiangularly spaced, axially aligned flexible spring members 18 are secured to the outer surface of payload 16. A mounting means or support bracket 26 is secured to the convex side of each arced central portion 20 of each spring member 18. (Only two spring members 18 are illustrated in FIG. 2. The third spring member and its associated support bracket 26 have been omitted from the left portion of the figure for the purpose of more clearly illustrating the launch tube mounting bracket 28.) Pre-deployment payload securing means or mounting brackets 28 are provided for securely maintaining the payload 16 within the launch tube prior to deployment. The surfaces of all three mounting brackets 28, to which the support brackets 26 interface, are coplanar and normal to the launch tube 12 centerline axis 14. Accordingly, the mating surfaces of support brackets 26 are also coplanar. Payload 16 axial positioning within the launch tube 12 is thus assured during assembly.

Figure 3:
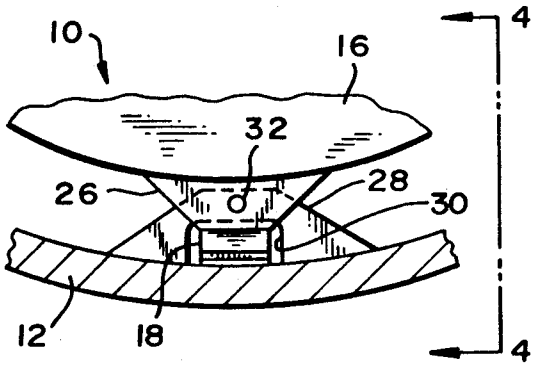
FIG. 3 is an enlarged view of an individual spring member, support bracket, and portion of the payload, illustrating its attachment to the mounting bracket of the launch tube, taken along line 3—3 of FIG. 2.
Figure 3B:
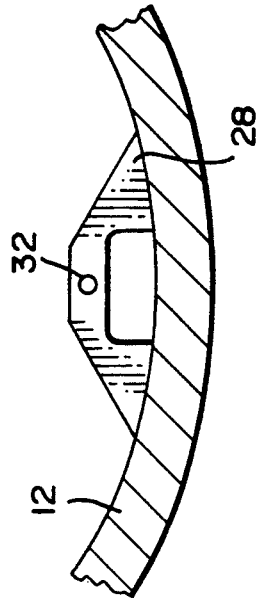
FIG. 3B is similar to FIG. 3 except the mounting bracket and partial launch tube are highlighted.
Figure 3A:
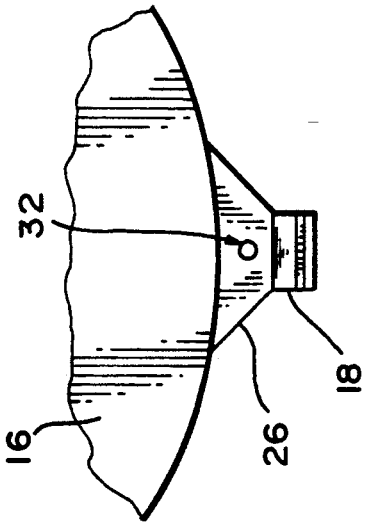
FIG. 3A is a similar view as FIG. 3 but illustrates the spring member, support bracket, and partial payload assembly.

FIG. 3 is an enlargement of a single support bracket 26 to mounting bracket 28 assembly within the launch tube 12, as referenced in FIG. 2. A spring member 18 is shown inserted through a cutaway portion 30 of the mounting bracket 28. (The cutaway portion 30 of the mounting bracket 28 can also be seen in FIG. 3B highlighting this detail. FIG. 3A is an isolated view of the payload 16/support bracket 26/spring member 18 assembly.) In a pre-deployment mode, each mounting bracket 28 and support bracket 26 are attached by a releasing fastener 32. Releasing fastener 32 may be, for example, an explosive bolt, a retracting solenoid, or other pyrotechnic, pneumatic, or electrically actuated device.

At the time of deployment of the payload 16, the releasing fasteners 32 are released. At such time, an ejection force is applied to the payload 16 by the desired means, which might be provided by payload axial thruster firing, a spring, gas bag, cold gas, etc. Additionally, the present ejection system could accommodate either recoil-less or reaction-type launches.

Fastener 32 provides for structural containment of the payload 16 within the launch tube 12 prior to payload 16 deployment from the launch tube 12. Furthermore, fastener 32 affords radial and rotational constraint of the payload 16 prior to deployment.

Figure 4:
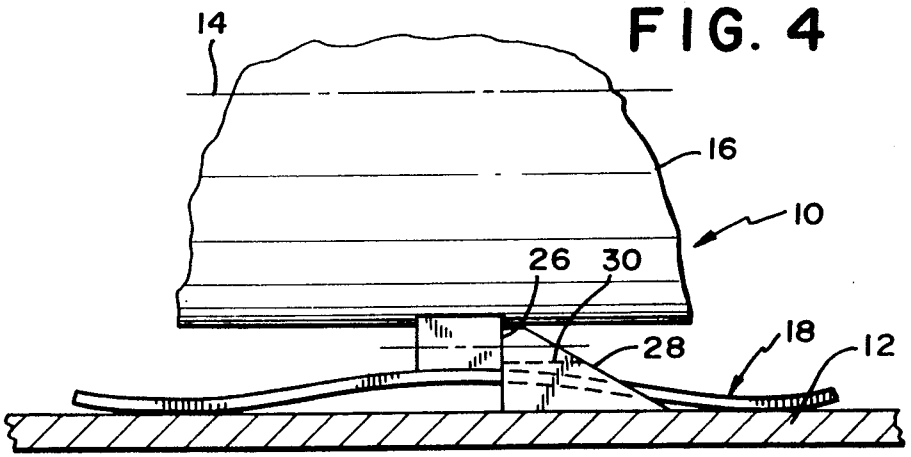
FIG. 4 is a profile view of FIG. 3.

FIG. 4 is a profile view taken of FIG. 3 and presents a portion of the ejection system of the present invention, designated generally as 10. An elongated launch tube 12 having an axial centerline 14 is provided for deploying the payload 16. The launch tube 12 is preferably of a continuous, cylindrical shape. However, it is neither required that the launch tube 12 be cylindrical in cross-section nor continuous about its periphery for the principles of the present invention to be utilized.

FIG. 4 further illustrates how the aft portion of the spring member 18 passes through the cutaway portion 30 of the launch tube mounting bracket 28.

Figure 4A:
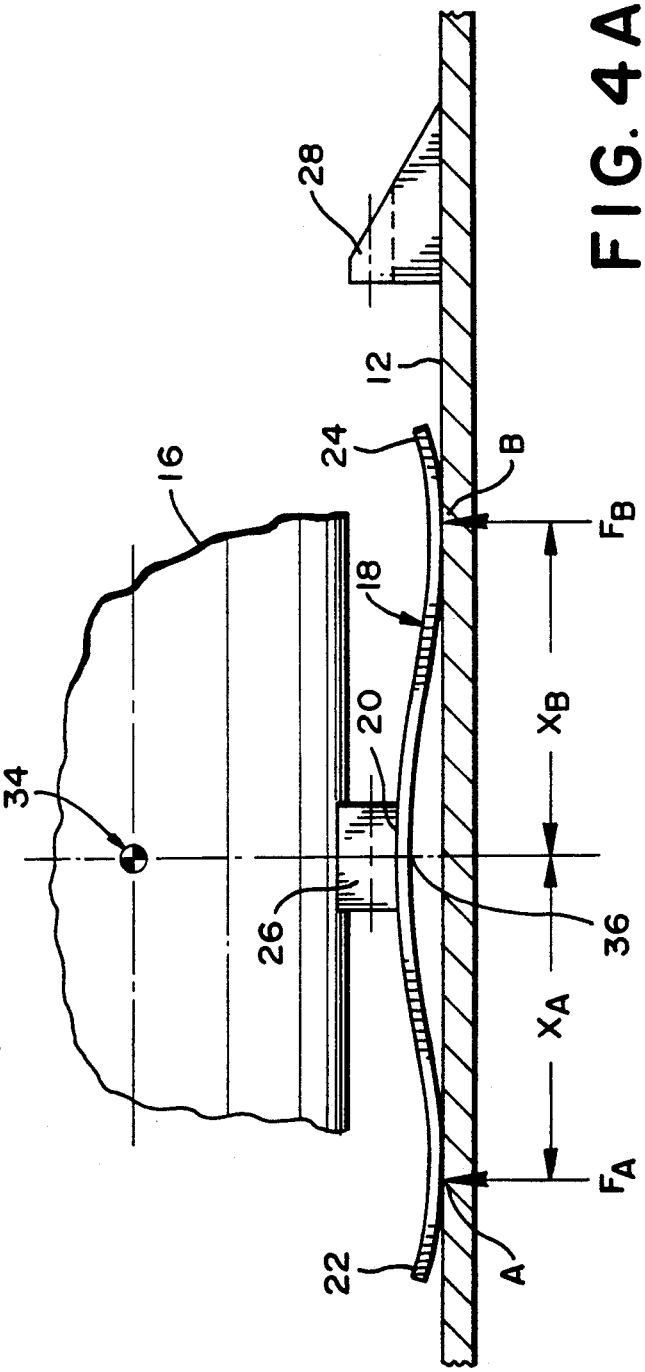
FIG. 4A is the same as FIG. 4 except the payload is illustrated displaced from the launch tube mounting bracket.

FIG. 4A is similar to FIG. 4 but shows the payload 16 displaced from the mounting bracket 28 as would occur during the ejection/deployment process. This figure allows a more thorough description of the spring member 18 and the operation of an individual spring member 18 during payload 16 ejection. Spring member 18 has convex forward and aft upturned ends (22 and 24, respectively) relative to the launch tube 12 inner surface. It is understood that the present invention is not limited to sliding frictional contacts at the spring member 18 and launch tube 12 interface and could be altered with wheels or rollers at each end of an individual spring member.

The upturned ends 22 and 24 accomodate irregularities in the launch tube 12 during payload 16 assembly and ejection by riding over any discontinuities.

Spring members 18 are fabricated to produce nearly identical spring rates and have mirror image ends. When preloaded by deflection radially inward during payload 16 installation into a launch tube 12, the preload forces are identical at either end of the spring member 18 and for all three spring members 18. Thus, each spring member provides a forward and aft dynamic interface between the payload 16 and the launch tube 12. The magnitude of the preload and the corresponding frictional force between the spring members 18 and launch tube 12 are tailorable to the specific application.

Payload 16 center of mass 34 is located equidistant from all six spring member 18 and launch tube 12 points of contact (two per spring member 18).

The fore and aft spring member 18 preload force reaction points and the payload center of mass 34 form an individual spring member plane. The line connecting the forward and aft spring member preload force reaction points A and B is bisected by the line passing through the payload center of mass 34 and the midpoint 36 of a spring member 18. Furthermore, these two lines are perpendicular to each other. Hence, equilibrium exists about the payload center of mass 34 relative to the moments (product of force times distance) produced by the forces at A and B for each spring member 18 defined plane. Each plane is equiangularly distributed about the launch tube axis 14.

The three contact points which have been defined at the forward part of the spring members determine both a plane and a circle. Similarly, the three aft contact points also define a circle. Thus, a cylindrical form is defined by the resulting forward and aft circles and a triplanar, three-dimensional, force/moment equilibrium state relative to the payload center-of-mass is provided by the present system. In each radially oriented plane containing the payload/launch tube axis and an individual flexible spring member, a moment balance exists about the payload center-of-mass. This feature not only accommodates discontinuities in the launch tube, but also accommodates unbalanced or overturning moments induced in the payload by the ejection force itself.

The springs members can be fabricated of various materials in sets (parted off of a common profile larger part) to insure maximum commonality of spring rate properties and finished dimensions. Various metals or non-metals can be used for the spring member material.

Obviously, many modifications and variations of the present invention are possible in light of the above teachings. For example, although the use of three flexible members is preferred, to achieve all functional requirements, under certain conditions more flexible members may be utilized. It is, therefore, to be understood that, within the scope of the appended claims, the invention may be practiced otherwise than as specifically described.

What is claimed and desired to be secured by Letters Patent of the United States is:

1. An ejection system for payload deployment in a low gravitation, exoatmospheric environment, comprising:

a) an elongated launch tube including pre-deployment payload securing means for securely maintaining a payload within said launch tube prior to deployment;

b) a payload mountable within said launch tube; and c) a plurality of equiangularly spaced, axially aligned flexible spring means secured to an outer surface of said payload, each spring means providing a forward and an aft dynamic interface between said payload and said launch tube, said plurality of spring means providing payload alignment relative to said launch tube prior to and throughout payload ejection.

2. The ejection system of claim 1, wherein each of said flexible spring means, comprises:

a spring member having an arced central portion being concave toward the launch tube and having forward and aft upturned ends; and, mounting means secured to a convex side of said central portion for securing said spring member to said payload.

3. The ejection system of claim 2, wherein said mounting means comprises a spring member support bracket.

4. The ejection system of claim 3, wherein said pre-deployment payload securing means comprises a plurality of mounting brackets each attached to a respective inner surface of said launch tube, each being associated with a respective leaf spring when the payload is mounted in the launch tube, each mounting bracket bridging a portion of its associated spring member just aft of said support bracket prior to deployment, each said mounting bracket and associated support bracket being securely attached prior to deployment by a releasing fastener.

5. The ejection system of claim 4, wherein said plurality of spring means comprises three of said flexible spring members.

6. The ejection system of claim 5, wherein said launch tube is substantially cylindrical.

* * * * *